US006300637B1

(12) United States Patent
Beu et al.

(10) Patent No.: US 6,300,637 B1
(45) Date of Patent: Oct. 9, 2001

(54) INCREASED IONIZATION EFFICIENCY IN A MASS SPECTROMETER USING ELECTRON BEAM TRAJECTORY MODIFICATION

(75) Inventors: Steven C. Beu, Austin, TX (US); Robert W. Arnold, Johnson City, NY (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 09/174,034

(22) Filed: Oct. 16, 1998

(51) Int. Cl.[7] ..... H01J 27/00
(52) U.S. Cl. ..... 250/427; 313/362.1
(58) Field of Search ..... 250/427, 423 R; 313/362.1

(56) References Cited

U.S. PATENT DOCUMENTS 3,610,985 * 10/1971 Fleming et al. ..... 250/427
3,619,684 * 11/1971 Andrew et al. ..... 250/427
3,764,803 10/1973 Nakajima .
3,787,681 1/1974 Brunnee et al. .
5,374,828 * 12/1994 Boumsellek et al. ..... 250/427

FOREIGN PATENT DOCUMENTS 0 624 898 A2 11/1994 (EP) .
2 191 334 A 12/1999 (GB) .

* cited by examiner

*Primary Examiner*—Bruce Anderson

(57) ABSTRACT

The ionization efficiency of a mass spectrometer is increased by creating a potential well between the electron source and the electron collector. The potential well is created by applying to the collector a reflection potential having an amplitude which is the same as or substantially the same as the amplitude of the potential applied to the electron source and a polarity which is the same as the polarity of the electron source potential. The potentials applied to the electron source and electron collector are relative to the ionization region effected between the source and collector. Many of the electrons produced by the electron source oscillate back and forth in the potential well thereby allowing those electrons a greater opportunity to interact with sample molecules to thus increase ionization efficiency.

12 Claims, 1 Drawing Sheet

INCREASED IONIZATION EFFICIENCY IN A MASS SPECTROMETER USING ELECTRON BEAM TRAJECTORY MODIFICATION

FIELD OF THE INVENTION

This invention relates to mass spectrometers and more particularly to the increase in the ionization efficiency in such a spectrometer.

DESCRIPTION OF THE PRIOR ART

Mass spectrometry is a technique for determining the mass of individual molecules by manipulating electrically charged (i.e., ionized) forms of these species in the gas phase. This information may be used to determine both the chemical composition and molecular structure of the ionized species. Because molecules are electrically neutral it is necessary to ionize the gas phase species of interest prior to mass analysis.

While there are many different techniques to accomplish ionization, the most widely used technique is to bombard the species of interest with energetic electrons. This process is referred to as electron ionization. In most cases the collision of an energetic electron with a molecule leaves the molecule with a positive charge as the exchange of energy results in the ejection of an electron from the molecule. There are some molecules that are capable of capturing an electron and therefore being left with a negative charge as a result of electron ionization; however, very low energy electrons must be used to obtain that result.

The energy delivered to a molecule during an electron ionization event may vary over a large range depending on the electron energy and the dynamics of a particular collision. Typically the energy delivered to the molecule is sufficient to not only accomplish ionization but to also fragment the initially created molecular ion by breaking chemical bonds. The original electrical charge must be distributed on the resulting fragments and thus the subsequent mass analysis will reveal the mass of the charged fragments. A molecule usually has many different fragmentation pathways available and the probability of following a particular pathway is determined by the internal distribution of the deposited energy and the relative strengths of different chemical bonds.

Because electron ionization typically results in the ionization of many molecules, the statistical distribution of charge and energy during fragmentations will result in a mixture of fragment and molecular ions that is characteristic of the original molecules. A plot of the mass versus relative number of this mixture of ions is referred to as a mass spectrum. Such a spectrum may be interpreted using known mechanisms and statistics of fragmentation to deduce the composition and structure of the original molecules. Alternatively, the spectrum may be compared to a library of known spectra in an attempt to find a matching spectrum and thereby determine the identity of the original molecules.

Electrons are usually created by an electron source such as a wire filament. Alternative means for producing electrons exist and include various other thermionic emitters, as well as field emitter arrays, etc.

When a wire filament is used as the electron source, the filament is heated to incandescence thereby causing electrons to be emitted from the filament. These electrons will have low kinetic energy and must be accelerated to a kinetic energy sufficient to ionize the sample molecules. The acceleration is provided by an electric field applied to the ionization region. The accelerated electrons are directed through a chamber which contains the gas sample to be ionized. The electrons that exit the chamber are typically collected by an electrode employed to measure the total electron flux or current. If the ionization chamber is at ground potential the electrons can be accelerated by placing a negative potential, typically in the order of −70V, on the filament.

Referring now to FIG. 1, there is shown a simplified diagram of a prior art mass spectrometer 10. The spectrometer 10 includes an electron source such as filament 12 which is connected to a power supply 14 which is used to heat the filament to incandescence. The filament 12 is also connected to a source 16 of negative potential with respect to the ionization chamber 18. The filament 12 is placed opposite an opening 18*a* in chamber 18. The chamber has another opening 18*b* through which the gas sample to be ionized enters the chamber and an opening 18*c* which is opposite opening 18*a* and adjacent an external collector 20. The collector 20 is connected through an ammeter 22 to ground potential. The accelerated electrons enter chamber 18 through opening 18*a* and exit the chamber through opening 18*c*. Spectrometer 10 also includes a magnet 24 which functions to constrain the electrons and increase the path length as the electrons travel a helical path between filament 12 and collector 20.

Each electron emitted from filament 12 has a low probability of encountering a sample molecule during its traversal of chamber 18. Therefore, the mass spectrometer of FIG. 1 has a low ionization efficiency which makes it difficult to obtain a flux or quantity of ions sufficient for detection of low concentration constituents of the sample stream.

Several techniques have been employed in the prior art to increase the ionization efficiency. One such technique is to increase the sample pressure and thereby increase the number density of molecules in the ionization region. This has the disadvantage of decreasing filament lifetime and may also require isolation and increased pumping of the mass analyzer region to avoid degradation of analyzer performance. Another such technique is to increase the electron emission by heating the filament 12 to higher temperature; however, this technique also has the disadvantage of reducing the life of filament 12.

Yet another technique is to increase the effective length of the electron trajectory through chamber 18 by immersing chamber 18 in a magnetic field to thereby effect a spiral electron trajectory through the chamber. The magnetic field is provided by magnet 24 and is a typical component of most electron ionization sources. As will be described in the description of the preferred embodiment(s), the ionization source of the present invention applies a reflecting voltage to the collector 20 to increase ionization efficiency. While the ionization source of the present invention does include magnet 24, the magnetic field of the magnet is used primarily in the present invention for radial focusing to ensure confinement of the electrons to a path connecting filament 12 and collector 20.

SUMMARY OF THE INVENTION

The present invention is a method for increasing ionization efficiency in a mass spectrometer (MS) that has an electron source for producing electrons. The MS also has an electron collector opposite said electron source to thereby effect an ionization region between the electron source and the electron collector. The method has the step of connecting to the electron source a first potential relative to the ionization region. The first potential has a predetermined amplitude and a predetermined polarity to cause electrons emitted by the electron source to traverse the ionization region.

The method also has the step of connecting to the electron collector a second potential relative to the ionization region having a predetermined amplitude and a predetermined polarity identical to the first potential predetermined polarity. This creates a potential well between the electron source and the electron collector.

The present invention is also an apparatus for increasing ionization efficiency in a mass spectrometer (MS). The MS has an electron source for producing electrons and an electron collector opposite the electron source to thereby effect an ionization region between the electron source and the electron collector. The apparatus has a first switch which when closed connects to the electron source a first potential relative to the ionization region. The first potential has a predetermined amplitude and a predetermined polarity to cause electrons emitted by the electron source to traverse the ionization region. The apparatus also has a second switch which when closed connects to the electron collector a second potential relative to the ionization region. The second potential has a predetermined amplitude and a predetermined polarity identical to the first potential predetermined polarity. This creates a potential well between said electron source and said electron collector.

The present invention is a method for creating a potential well between the electron source and electron collector of a mass spectrometer. The electron source produces electrons and the electron collector is opposite the electron source thereby effecting an ionization region between the electron source and the electron collector. The method has the step of selecting from a range of amplitudes the amplitude of a first potential relative to the ionization region to be applied to the electron source with a polarity to cause electrons emitted by the electron source to traverse the ionization region. The method further has the step of selecting from a range of amplitudes the amplitude of a second potential relative to the ionization region to be applied to said electron collector with a polarity to produce the potential well. The method also further has the steps of applying the first potential to the electron source; and applying the second potential to said electron collector.

The present invention is a mass spectrometer (MS) that has an electron source for producing electrons. The MS also has an electron collector opposite the electron source thereby effecting an ionization region between the electron source and the electron collector. The MS further has a power supply for producing a first potential that has an amplitude selected from a range of amplitudes that is connected to the electron source with a polarity that causes electrons emitted by the electron source to traverse said ionization region. The power supply produces a second potential that has an amplitude selected from a range of amplitudes that is connected to the electron collector with a polarity to produce a potential well between the electron source and the electron collector.

DESCRIPTION OF THE PREFERRED EMBODIMENT(S)

The present invention increases ionization efficiency in a mass spectrometer by providing to collector 20 a reflection potential with respect to chamber 18 that is substantially equal to or more negative than the potential difference maintained between the filament 12 and chamber 18 by the voltage source 16. The voltage provided to the collector 20 creates a potential well between the collector and the filament 12 as the collector reflects rather than collects electrons. Therefore many of the electrons produced by filament 12 oscillate back and forth in the potential well thereby allowing those electrons a greater opportunity to interact with sample molecules to thus increase ionization efficiency.

Figure 2:
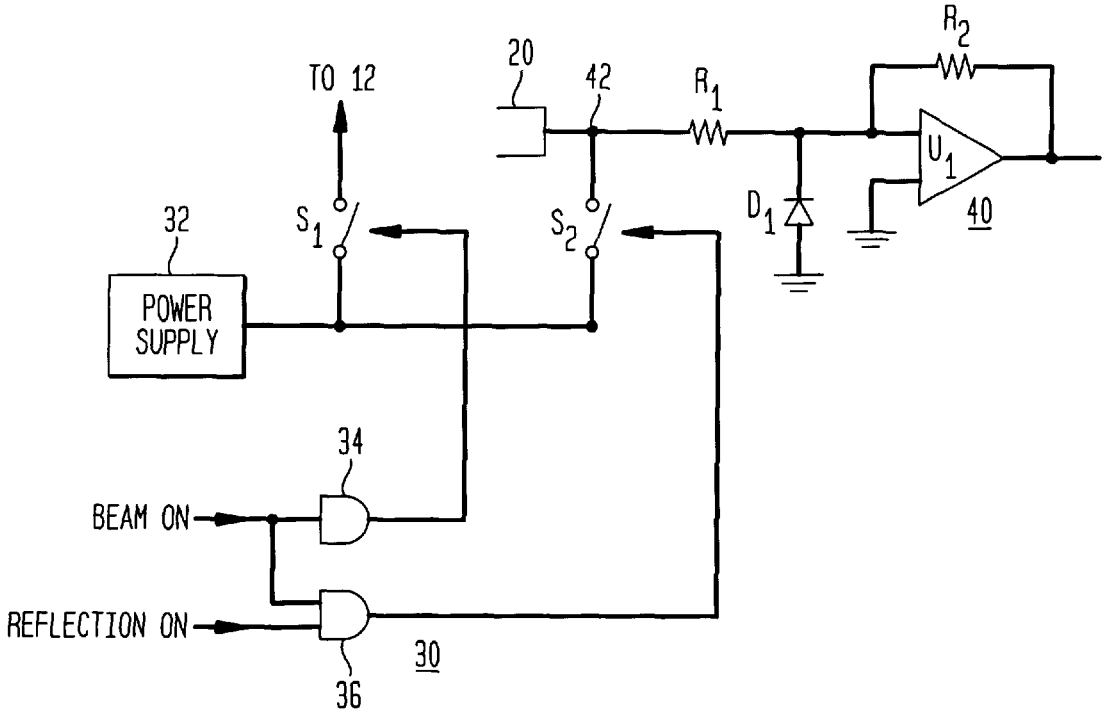
FIG. 2 shows a diagram for a circuit that in accordance with the present invention increases the ionization efficiency in a mass spectrometer.

Referring now to FIG. 2, there is shown a schematic for a circuit 30 that in accordance with the present invention increases the ionization efficiency in a mass spectrometer. Circuit 30 includes a power supply 32 that has an output voltage whose amplitude can be selected by software in a manner well known to those of ordinary skill in the art. The selectable amplitude of supply 32 covers the range of 0 Volts to V1 Volts and includes the amplitude of the voltage that is provided in the prior art mass spectrometer by source 16 to the filament 12.

Figure 1:
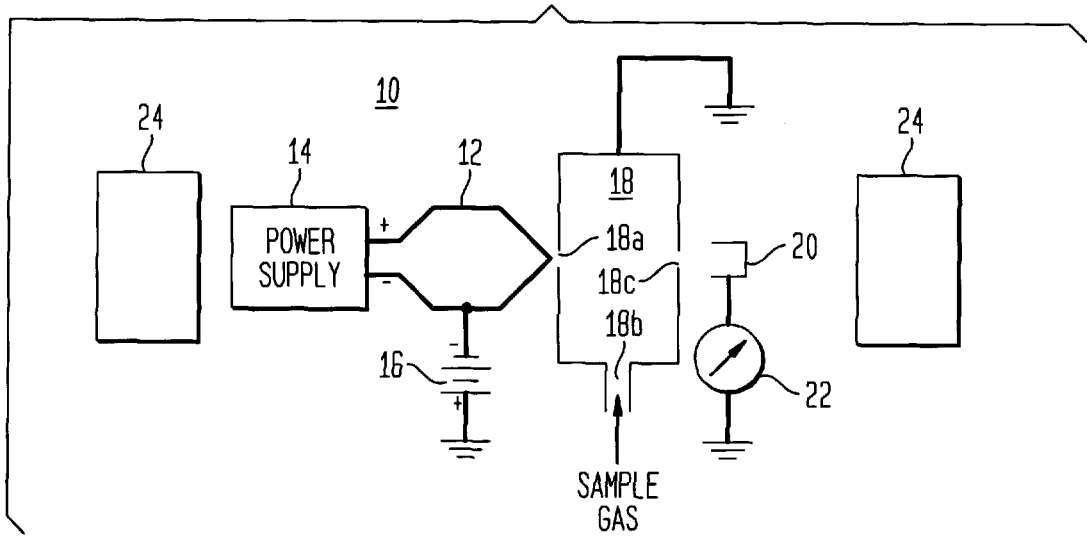
FIG. 1 (PRIOR ART)
FIG. 1 shows a simplified diagram of a prior art mass spectrometer.

Circuit 30 further includes first and second switches S1 and S2, respectively. Switch S1 when closed connects power supply 32 to the filament 12. Therefore, selectable amplitude power supply 32 replaces source 16 of FIG. 1. Switch S2 when closed connects power supply 32 to collector 20. Therefore, when both switches are closed the same voltage is provided to both the filament 12 and the collector 20 and a potential well is created between the filament and the collector.

Circuit 30 also includes one input AND gate 34 whose output is used to control switch S1 and two input AND gate 36 whose output is used to control switch S2. Switch S1 is closed during an electron ionization event in the mass spectrometer. When it is desired to increase the ionization efficiency in the mass spectrometer switch S2 is closed at the beginning of an ionization event to thereby provide to collector 20 the same voltage that is provided to filament 12 by supply 32. Therefore the signal into the single input of gate 34 and to one input of gate 36 is indicative of the occurrence of an ionization event and the signal into the other input of gate 36 is indicative if the mass spectrometer is increasing its ionization efficiency in accordance with the present invention.

Also shown in FIG. 2, is a circuit 40 connected to the collector 20 that is used to determine the current of the electron beam. Circuit 40 includes a resistor R1 connected between junction 42 and one input of operational amplifier U1. A resistor R2 connects the output of the amplifier U1 to that same input. A diode D1 connects that same input to ground. The other input to amplifier U1 is connected to ground.

It should be appreciated that the present invention can be used to increase the ionization efficiency in mass spectrometers of any type. Thus the present invention can be used to increase the ionization efficiency in mass spectrometers in which the electron beam is pulsed on for a predetermined period of time such as a Fourier transform ion cyclotron resonance mass spectrometer, and in mass spectrometers in which the electron beam is on continuously such as a quadrupole mass spectrometer.

It should also be appreciated that while the present invention has been described in connection with a filament as the electron source that the invention may also be used with other electron sources such as various other thermionic emitters, field emitter arrays or heating a crystal to thereby provide a point source of electrons.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. An apparatus for increasing ionization efficiency in a mass spectrometer that has an electron source for producing electrons and an electron collector opposite said electron source thereby effecting an ionization region between said electron source and said electron collector, said apparatus comprising:

a. a first switch when closed connecting to said electron source a first potential relative to said ionization region having a predetermined amplitude and a predetermined polarity to cause electrons emitted by said electron source to traverse said ionization region; and b. a second switch when closed connecting to said electron collector a second potential relative to said ionization region having a predetermined amplitude and a predetermined polarity identical to said first potential predetermined polarity;

to thereby create a potential well between said electron source and said electron collector.

2. The apparatus of claim 1 further comprising a circuit responsive to a first signal indicative that electrons are to be produced for closing said first switch and responsive to said first signal and a second signal indicative that said potential well is to be created for closing said second switch.

3. The apparatus of claim 2 wherein said circuit comprises a first logic element responsive to said first signal for closing said first switch and a second logic element responsive to both said first and second signals for closing said second switch.

4. The apparatus of claim 1 wherein said mass spectrometer is of a type in which said electrons are produced for a predetermined period of time and said apparatus further comprises a circuit responsive to a first signal indicative that electrons are to be produced for said predetermined period of time for closing said first switch and responsive to said first signal and a second signal indicative that said potential well is to be created for closing said second switch.

5. The apparatus of claim 4 wherein said circuit comprises a first logic element responsive to said first signal for closing said first switch and a second logic element responsive to both said first and second signals for closing said second switch.

6. The apparatus of claim 1 wherein said second potential predetermined amplitude is equal to said first potential predetermined amplitude.

7. The apparatus of claim 1 wherein said second potential predetermined amplitude is substantially equal to said first potential predetermined amplitude.

8. A method for creating a potential well between the electron source and electron collector of a mass spectrometer, said electron source for producing electrons and said electron collector opposite said electron source thereby effecting an ionization region between said electron source and said electron collector, said method comprising the steps of:

a. selecting from a range of amplitudes the amplitude of a first potential relative to said ionization region to be applied to said electron source with a polarity to cause electrons emitted by said electron source to traverse said ionization region;

b. selecting from a range of amplitudes the amplitude of a second potential relative to said ionization region to be applied to said electron collector with a polarity to produce said potential well;

c. applying said first potential to said electron source; and d. applying said second potential to said electron collector.

9. A mass spectrometer comprising:

a. an electron source for producing electrons;

b. an electron collector opposite said electron source thereby effecting an ionization region between said electron source and said electron collector; and c. a power supply for producing a first potential having an amplitude selected from a range of amplitudes that is connected to said electron source with a polarity that causes electrons emitted by said electron source to traverse said ionization region, and a second potential having an amplitude selected from a range of amplitudes that is connected to said electron collector with a polarity to produce a potential well between said electron source and said electron collector.

10. The mass spectrometer of claim 9 further comprising:

a. a first switch which when closed connects said first potential to said electron source; and b. a second switch which when closed connects said second potential to said electron collector.

11. A method for increasing ionization efficiency in a mass spectrometer that has an electron source for producing electrons and an electron collector opposite said electron source thereby effecting an ionization region between said electron source and said electron collector, said method comprising the steps of:

a. connecting to said electron source a first potential relative to said ionization region having a predetermined amplitude and a predetermined polarity to cause electrons emitted by said electron source to traverse said ionization region; and b. connecting to said electron collector a second potential relative to said ionization region having a predetermined amplitude and a predetermined polarity identical to said first potential predetermined polarity;

to thereby create a potential well between said electron source and said collector wherein said first potential predetermined amplitude is selectable from a predetermined range of amplitudes.

12. A method for increasing ionization efficiency in a mass spectrometer that has an electron source for producing electrons and an electron collector opposite said electron source thereby effecting an ionization region between said electron source and said electron collector, said method comprising the steps of:

a. connecting to said electron source a first potential relative to said ionization region having a predetermined amplitude and a predetermined polarity to cause electrons emitted by said electron source to traverse said ionization region; and b. connecting to said electron collector a second potential relative to said ionization region having a predetermined amplitude and a predetermined polarity identical to said first potential predetermined polarity;

to thereby create a potential well between said electron source and said electron collector wherein said second potential predetermined amplitude is selectable from a predetermined range of amplitudes.

* * * * *